US006484474B1

(12) United States Patent
Knieriem

(10) Patent No.: US 6,484,474 B1
(45) Date of Patent: Nov. 26, 2002

(54) DEVICE FOR PRODUCING FILLED, SEALED TUBULAR POUCH PACKAGING

(76) Inventor: Guenter Knieriem, Scheffelstrasse 5, D-68526 Ladenburg (DE)

( * ) Notice: Subject to any disclaimer, the term of this patent is extended or adjusted under 35 U.S.C. 154(b) by 0 days.

(21) Appl. No.: 09/581,003

(22) PCT Filed: Nov. 16, 1998

(86) PCT No.: PCT/DE98/03364

§ 371 (c)(1),
(2), (4) Date: Jul. 20, 2000

(87) PCT Pub. No.: WO99/29574

PCT Pub. Date: Jun. 17, 1999

(30) Foreign Application Priority Data

Dec. 6, 1997 (DE) ..... 197 54 199

(51) Int. Cl.[7] ..... B65B 51/04
(52) U.S. Cl. ..... 53/138.4
(58) Field of Search ..... 53/138.4, 551; 29/243.56, 243.57

(56) References Cited

U.S. PATENT DOCUMENTS

| | | | | | |
|---|---|---|---|---|---|
| 819,466 | A | * | 5/1906 | Staude | 53/138.4 |
| 3,795,083 | A | * | 3/1974 | Wells | 29/243.57 |
| 4,211,051 | A | * | 7/1980 | Tucker | 53/138.4 |
| 4,218,861 | A | * | 8/1980 | Marz | 53/138.4 |
| 4,939,885 | A | * | 7/1990 | Steinke | 53/138.4 |

FOREIGN PATENT DOCUMENTS

| | | | |
|---|---|---|---|
| DE | 1101997 | | 3/1961 |
| DE | 3610010 | | 10/1987 |
| DE | 29613336 | | 10/1996 |
| EP | 0685397 | | 12/1995 |
| NL | 8702684 | * | 6/1989 |

* cited by examiner

*Primary Examiner*—John Sipos
(74) *Attorney, Agent, or Firm*—Milde & Hoffberg, LLP

(57) ABSTRACT

Described is a device for producing filled, sealed tubular pouch packaging from a filled flexible tube (5). The filled flexible tube is compressed to form the ends of two successive tubular pouch packagings. The entire compressed area of the flexible tube is closed with two interspaced closing clips. Two groups of compression sheets (1–4) on two opposite sides can be displaced on the area of the tube to be compressed. Means for cutting and bending the wire (42) for the closing clips (85) and a conveyor device for the U-shaped closing clips (85) to convey the latter to the compression zone are provided. The compression sheets (1–4) and the cutting bending devices can be driven by a common drive shaft (14) by means of disc cams (21, 26, 22, 27).

16 Claims, 6 Drawing Sheets

11
7
3
1
42
6
40
36
53
31
52
33
48
28
21
8
22
23
24
25
26
9
27
14
15
34
32
37

45
44
47
50
46

DEVICE FOR PRODUCING FILLED, SEALED TUBULAR POUCH PACKAGING

BACKGROUND OF THE INVENTION

The invention concerns a mechanism to produce filled, sealed tubular bag packages from a filled tube whereby the filled tube is constricted to form the ends of two sequential tubular bag packages, and the constricted area of the tube is sealed by two surrounding, separated bent wire closures whereby two groups of constricting plates may be pressed from both sides against the area of the tube to be constricted, and whereby devices to cut and bend the wire used as bent wire closures, and a transport mechanism for the U-shaped bent wire closures used to seal the constricted area, are provided, whereby the cutting and bending mechanisms each feature a bending stamp and a cutting block outside on the constricting plates of one group and fixed counterpieces, and are driven with the constricting plates, and whereby the transport mechanism is arranged between the constricting plates of one group and is formed by one of the rods running in the groove, distinguished by the facts that the constricting plates together with the cutting and bending mechanisms may be driven by a common drive shaft via cam disks rotating around the common drive shaft, and that two bi-directionally operating cam disks are provided for each group of constricting plates, and one additional bi-directionally operating cam disk is provided for the transport mechanism.

The European Patent No. EP 0 685 397 C1 contains a description of a mechanism intended to produce filled, sealed tubular bag packages from a filled tube in which the drive for individual moving parts of the mechanism is provided by various pneumatic cylinders. This drive mode has enjoyed wide acceptance, but is not well suited for high output, e.g., more than 45 cycles per minute. Additionally, it is characterized by high energy consumption and sound levels.

The published German Patent Application No. DE-AS 11 40 851 published the principle of providing drive for the mechanism's moving parts by means of linear moveable cam templates. This, however, results in the problem that the movement must be symmetrical to the axis of the tubular bag package so that the tube is not displaced. The published design requires a double drive that must be synchronized. This causes the mechanism to be large and expensive.

A mechanism for the packaging of sausage for which the parts necessary to seal the sausages are driven by rotating cam disks is known from the published German Patent Application No. DE-AS 11 01 997. The design is also rather expensive, however, since a large quantity of components is required to support and drive the cam disks.

The German Patent No. DE 36 10 010 C2 describes a mechanism intended to divide tubular shells in which the moving parts are also driven by rotating cam disks. This design is characterized by high manufacturing expense since the cam disks must act in two directions.

The German Patent No. DE 296 13 336 U1 features a mechanism intended to seal tubular bags for which cam disks are used from one side to move the clamping tools. The tubular bags are separated before clamping by means of a constricting plate operated by a lever mechanism that may be rotated. This design also requires many parts that move in various manners, and is therefore expensive.

Further, the known mechanisms feature difficulties during the sealing of tubular bags with a simple bent wire closure that is placed around the end of the constricted bag since the tubular bag material may slip out of the clamp.

SUMMARY OF THE INVENTION

The principal object of this invention is to provide a mechanism, of the type described above that avoids these disadvantages, and particularly which allows higher output.

This object as well as other objects and advantages which will become apparent from the discussion that follows, are achieved by the invention in that the constricting plates and that the bending and cutting mechanisms are driven by a common drive shaft via cam disks, and that two bi-directionally operating cam disks are provided for each group of constricting plates, and one bi-directionally operating cam disk is additionally provided for the transport mechanism.

The mechanism with central cam disk drive based on the invention allows a synchronous procedure without stop times. During this procedure, individual functions are coordinated for mutual compatibility so that they may be performed in series or parallel without stop times. The overall time from the production of the bent wire closure to the completed, sealed package is thereby shortened, allowing the desired increased output rate.

Significant improvements achievable by this invention include:

- Priceworthy manufacture of the mechanism;
- Reduced energy consumption and thereby reduced operating costs;
- Simple construction and low maintenance;
- Simple, easy disassembly and reduced cleaning expense, which is of particular advantage when daily cleaning is required; and
- High level of functional and operational safety.

A mechanism based on this invention can perform the following functions:

- Measured extraction of the bent wire closure wire from a supply roll and insertion into a cutting station;
- Cutting the closure wire;
- Shaping the bent wire closure;
- Transporting the bent wire closure;
- Constricting the tubing material so that the product packaged in the tubular bag package is excluded from the clamping area;
- Affixing and securing the bent wire closure;
- Rolling the bent wire closures, i.e., sealing the constricted area with two clamps, one at the end of the finished package and one at the beginning of the next package; and
- Cutting, i.e., separating the packages by cutting between the two closed bent wire closures.

A mechanism based on this invention may be so constructed that all movements are passed radially and parallel to the functional elements via pushrods, thus saving space.

This elaboration also preferably provides, as shown in the aforementioned European Patent No. EP 0 685 397, that the completed bent wire closures be pushed from the cutting and bending mechanism through openings in the external constricting plates by plungers driven by rocker arms and additional cam disks.

A cutting mechanism intended to separate the tubular bag packages also requires a drive in the direction of the constricting plates positioned opposing it, but offset in time from it. An additional cam disk for this drive may be avoided by the advantages of the mechanism in accordance with the invention by the fact that at least one of the cam disks provided for the group of external constricting plates features an additional cam lobe used to operate the cutting mechanism.

Movements of the cam disks and the functional elements of the mechanism based on the invention are a closed system, i.e., they are balanced and adjusted with respect to one another so that no oscillations or vibrations are passed to the support to which the mechanism based on the invention is attached.

Another advantageous embodiment of the invention includes the fact that the wire advancing mechanism may be driven by a chain drive connected with the common drive shaft, and two clamping mechanisms may be provided which open alternately, whereby one of the clamping mechanisms may be moved by a cam disk back and forth in the direction of wire travel. This establishes an advantageous drive for the wire being moved perpendicular to the overall movement direction that is synchronous with the other motions of the mechanism based on the invention.

A compact and space-saving design is achieved by another advantageous embodiment of the invention by including two extended strips in the direction of constricting plate motion, as described in the European Patent No. EP 0 685 397. The ends of these strips are connected to a frame, and act for most of their length as guides for supporting blocks that hold the constricting plates, and which also feature a support for the common drive shaft whereby the strips preferably are provided with slots for the wire cutting and bending mechanisms.

The mechanism based on the invention is preferably so configured that one rotation of the common drive shaft provides one cycle of the constricting plates, transport and closing of the bent wire closures, and separation of the tubular bag packages.

The mechanism based on the invention preferably features a continually adjustable rotational speed of the common drive shaft particularly in order to provide synchronization of the pre- and post-function devices.

A preferred embodiment of the invention is envisioned whereby the cam disks are so shaped that that the time during which the constricting plates are open exceeds the time for which they are closed. This offers the possibility of integrating the time required to fill the bag, during which the filled bag is fed between the opened constricting plates into the overall procedure of the sealing mechanism without interrupting the continuous operation of the sealing mechanism. In this manner, the sealing mechanism may operate in a continuous, energy-saving manner. Thus, it would no longer be necessary that the portioning mechanism positioned before the sealing mechanism operate in sequence with the sealing mechanism, that is, the sealing mechanism might begin to operate after the portioning procedure.

Using the mechanism based on the invention, filled tubular bags are preferably sealed in such a manner that the filling material is forced out of the constricted area of an already filled bag by the constricting plates, producing an air-free filling. This is possible for almost all filling products such as foodstuffs, or other highly viscous products such as caulking material, which are smooth, slippery, and viscous, and which do not contain high-friction components.

This is not possible for filling materials such as mortar which feature corundum, quartz sand, glass, silica, or other high-friction components, since these granular components would only partially slide out of the constricted area during constriction of the filled tube, leaving a remainder clamped in the folds of the constricted tube, thereby perforating the tube during the constricting or sealing procedure. The tubular bag package would therefore leak in this area, allowing at least the less-viscous components of the filling to escape. In order to prevent these disadvantages, existing filling devices leave the closure area free of filled material, which means that the tubular bag package is not completely filled.

In order to prevent these disadvantages and to ensure that even bags containing granular materials are completely filled and are capable of being sealed with bent wire closures, a further embodiment of the invention might feature displacement along the longitudinal direction, in contrast to tubular bag packages fed from above, and cam disks shaped so that the constriction begins above the fill height, is continued during lowering of the mechanism, and the seal is completed using bent wire closures when the constriction has reached the fill height.

Such a further improvement has the advantage that the tubular bag packages can be completely filled with granular material without damaging the shell material. During lowering of the mechanism, the area to be constricted is already partially constricted, but the air still located above the filling material may be forced out of the tubular bag package. Only then would the constrictors close completely and the bent wire closure be affixed. The movement required by this improved embodiment of the invention is shown in FIG. 1 designated with a double arrow.

The mechanism based on the invention creates bent wire closures automatically from continuous wire, i.e., the wire is inserted a predetermined distance into the cutting station where it is cut. Damaged, dull, or poorly-adjusted cutting knives allow the danger that the contact interface, i.e., the edge of the bent wire closure in contact with the filled portion of the package might not be clean and smooth, but rather sharp and jagged. Since the bent wire closure is pressed tight against the package material when it is rolled shut, damage to the material cannot be excluded.

In order to prevent this hazard, a further development of the mechanism based on this invention might include a notching element to align the wire to its subsequent position at the interface before cutting which is so arranged that the edge of the bent wire closure in contact with the filled portion of the package is provided with a smooth, rounded surface.

A particularly advantageous further development of the mechanism based on this invention includes notching tools integrated into the holding jaws of the wire supply feed mechanism. The holding jaws of the wire supply feed mechanism would thus be equipped with notching tools, and the closing force might be so adjusted that the sealing wire may be pre-shaped at the desired place.

Closed bags sealed with the bent wire closures are often subjected to over-pressure after production, e.g., from pressure induced by stacking on pallets for storage whereby the weight of upper-layer packages is supported by those in the lower layers. Over-pressure may also be caused by thermal post-processing of foodstuff packages, e.g., sausages being preserved (boiling, smoking, etc.). These heating processes may create increased internal pressure. This may lead to release of the bent wire closure and thereby destruction of package integrity, particularly when a slippery or greasy packaging material is involved.

In order to prevent such damage and to achieve a reliable seat for the bent wire closure onto the packaging material, use of bent wire closures featuring a profile on the interior surface is known, e.g., from Austrian Patent No. AT 171 031 or German Patent No. DE 38 11 978 C1.

An advantageous mechanism used to bend and cut the bent wire closures may also be employed in the mechanism based on this invention in that it may employ a stamp to produce a high-friction profile on the contact surface of the sealing wire while it is being shaped. This allows simple production of the high-friction profile, also known as a gripping pattern, without requiring a previous functional step to impress the profile onto the wire, and without allowing the bending process to damage or destroy the profile. Such damage has been prevented according to the German Patent No. DE 38 11 978 C1 by selecting a gripping pattern consisting of comprehensive depressions, since these are not subject to damage under high pressure.

Using a mechanism based on the invention, other profiles could be stamped that are selected for their improved gripping characteristics, particularly gripping profiles featuring raised bumps. Such a mechanism based on the invention could be improved to include arrangement of the bumps in several rows, with the bumps in each row symmetrically offset from each other. For this, the bumps might be lens-shaped, triangular pyramid-shaped, or square pyramid-shaped, and/or the pattern might include a center row of bumps consisting of several bead-shaped bumps arranged along the longitudinal direction of the gripping profile.

For a full understanding of the present invention, reference should now be made to the following detailed description of the preferred embodiments of the invention as illustrated in the accompanying drawings.

DESCRIPTION OF THE PREFERRED EMBODIMENTS

Figure 1:
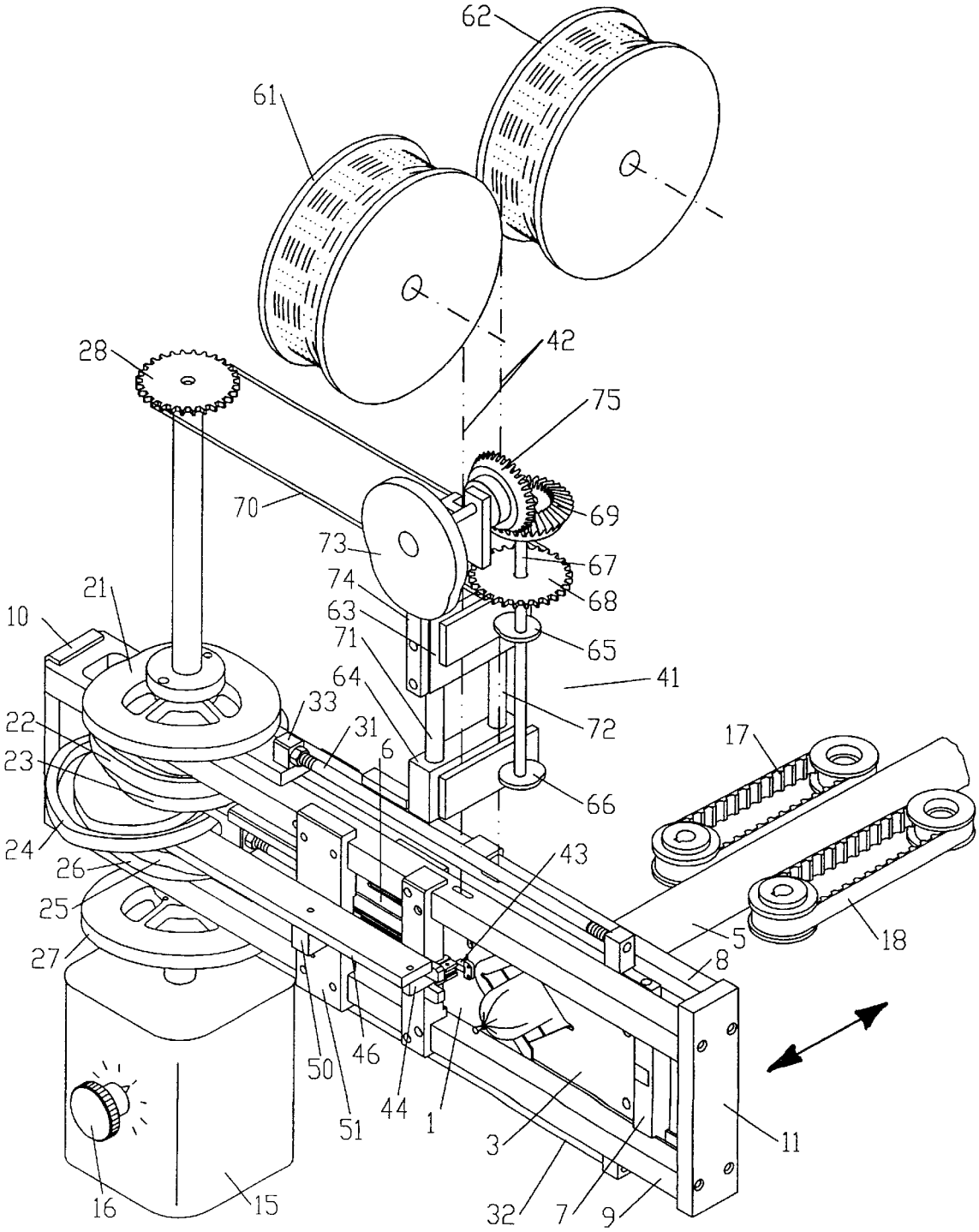
FIG. 1 is a perspective drawing of a sample mechanism.

The present invention will now be described with reference to FIGS. 1–12 of the drawings. Identical elements in the various figures are identified by the same reference numerals.

The quantity of constricting plates may be chosen by a specialist in individual cases. However, eight constricting plates are usually selected. The sample mechanism features four constricting plates 1, 2, 3, 4 for reasons of increased visibility, of which constricting plates 1, 2 are gripping a filled tube 5 from one side, and constricting plates 3, 4 from the other side, and are constricting to the point where a bent wire closure may be affixed for closure. Constricting plates 1, 2 are held by a supporting block 6, and constricting plates 3, 4 are held by a supporting block 7. Supporting blocks 6, 7 feature guides both above and below which fit onto guide rails 8, 9. The guide rails 8, 9, together with end pieces 10, 11, form a frame that guides the constricting plates and also features bearings 12, 13 to support the common drive shaft 14. The drive shaft 14 is connected to a drive motor 15 whose rotational speed may be adjusted by means of a regulator 16.

The drive shaft 14 drives a total of seven cam disks 21 through 27 and a chain gear 28. The cam disks 21 through 27 and the chain gear 28 are firmly attached to the drive shaft in the normal manner using groove-and-tongue or "slot- and feather" joints.

Motion of the constricting plates 3, 4 results from cam disks 21, 27, each of which features a surrounding groove, allowing bi-directional function. Power transfer between the cam disks 21, 27 and the supporting block 7 is via rods 31, 32, one end of each of which is connected to the supporting block 7. The other ends feature a bearing plate with one axis each for rollers 33, 34 that roll in their assigned groove.

In a similar manner, the supporting block 6 for constricting plates 1, 2 is moved by a rod 36, 37 from cam disks 22, 26 which are arranged in a similar manner to the cam disks 21, 27 for constricting plates 3, 4. Rollers also move in their own grooves here. Cam disk 22 additionally features a lobe 38 that moves a pushrod 40 via a roller 39 providing drive to a cutting mechanism. A spring (not shown) guides the pushrod 40 back to its initial position after the finished tubular bag package has been cut.

Wire supplied by a wire supply mechanism 41 (to be described in detail later) is fed along the lines 42 to a bending and cutting mechanism that is shown circled in FIG. 2, and in more detail in FIG. 5. This mechanism does not require a separate drive, since the cutting and bending of the wire is powered by the motion of the constricting plates 1, 2. The U-shaped bent wire closures are then pushed through openings 43 in the constricting plates 1, 2 into a transport mechanism. For this, plungers 44, 45, rocker arms 46, 47, and rollers 48, 49 are provided that each operate from a cam disk 25, 23. Consoles 50 arranged on struts 51 attached to the guide rails 8, 9 serve as rotational supports for the rocker arms 46, 47. The transport mechanism is not shown in the figures, but is described in detail in the European Patent No. EP 0 685 397 C2.

An additional cam disk 24 serves, together with roller 52 and a rod 53 (FIG. 4), as the drive for the transport mechanism of the U-shaped bent wire closures from a position behind the opening 43 to the constricted tubular bag package (closed position).

The wire supply mechanism includes two supply spools 61, 62 and two clamping mechanisms 63, 64 by means of which the wires may be clamped between a block and a clamping plate. The clamping mechanisms 63, 64 are operated in alternation by lobe disks 65, 66 whereby the lobe disks are arranged on a drive shaft 67 with a chain gear 68 and a bevel gear 69. Along with the chain gear 68 and a chain 70, the bevel gear 69 forms a chain drive with a transfer ratio of 1:1 so that the drive shaft 67 is driven synchronously with the drive shaft 14.

The upper clamping mechanism 63 is vertically moveable on two guide rods 71, 72, and is moved up and down by cam disk 73, which is connected with a rod 74. For this, the cam disk is driven by a bevel gear 75 connected with the bevel gear 69. Bevel gears 69 and 75 have the same tooth count, so that the cam disk 73 is moved synchronously with the cam disks 21 through 27 mounted on the drive shaft.

While the clamping mechanism 63 moves downward into its closed position, the immovable clamping mechanism 64 is opened so that the wires are advanced. When the clamping mechanism 63 is in its lower position, the clamping mechanism 64 is closed and the clamping mechanism 63 is opened, so that it may return to its upper position without moving the wires.

The filled tube 5 is forwarded from a tubular bag package filling mechanism which is already known, and which need not be described further in connection with this invention. Only sheet extraction bands 17, 18 are shown in FIG. 1 to explain the movement of the tube 5 that has been filled. A suitable tubular bag package filling mechanism is described in European Patent No. EP 0 739 292 C2, for example.

Figure 2:
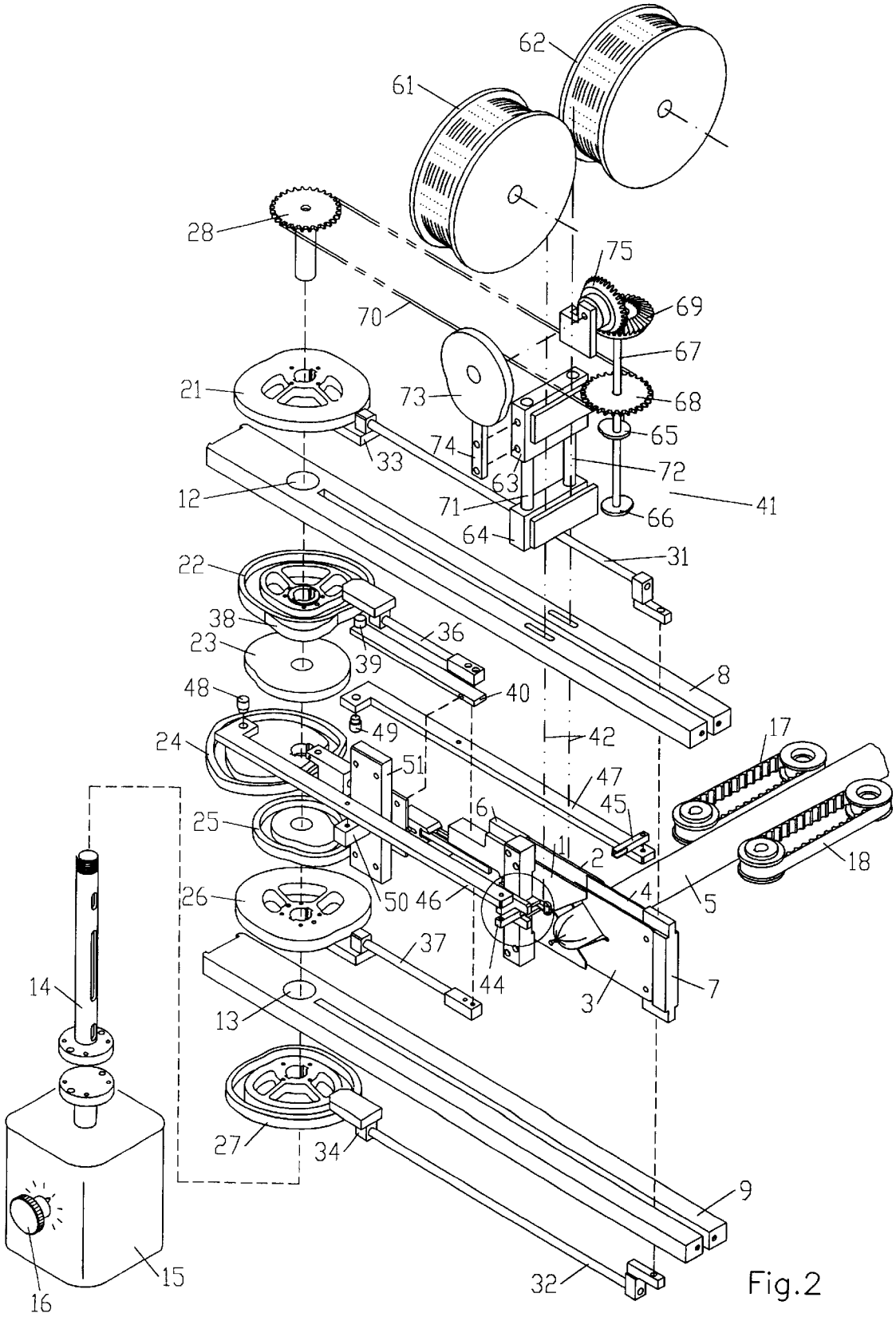
FIG. 2 is an exploded view of a sample mechanism.
Figure 3:
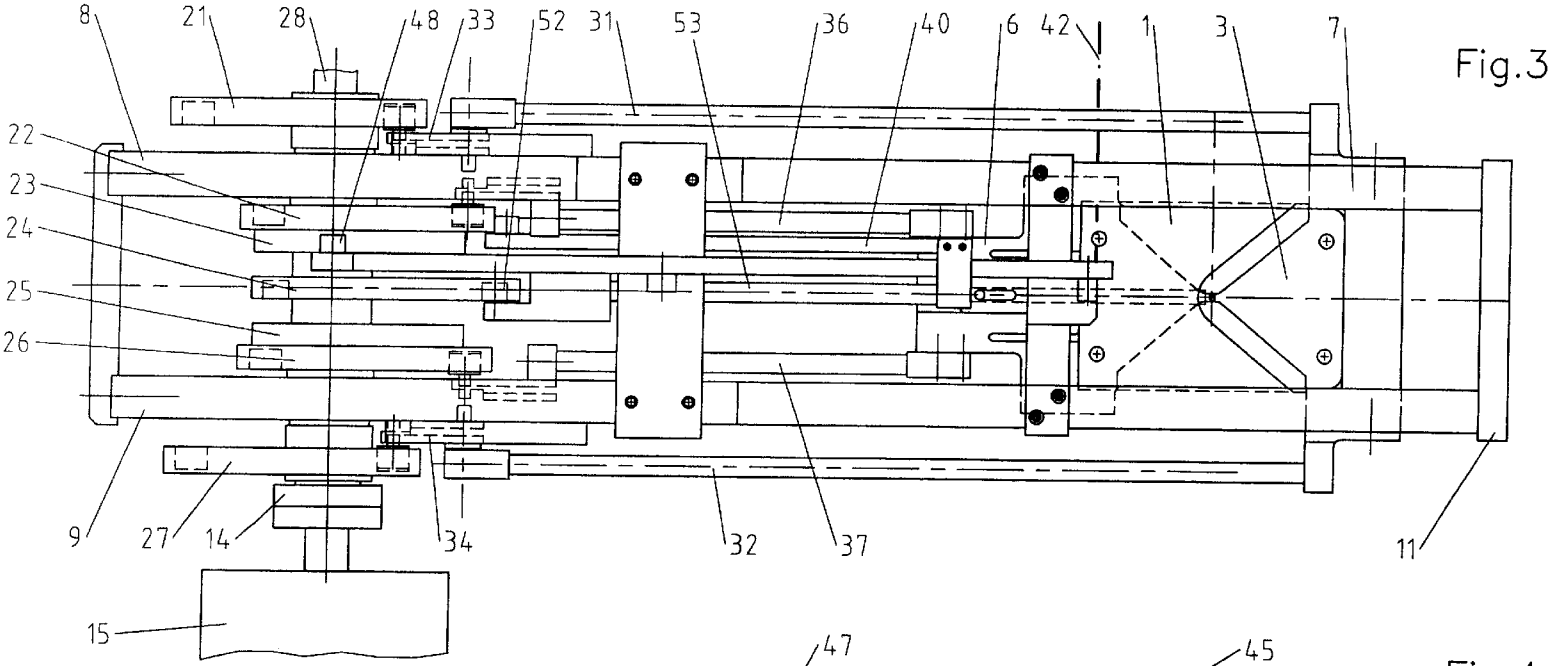
FIG. 3 and FIG. 4 are two views of a portion of a sample mechanism as shown in FIGS. 1 and 2 respectively.
Figure 4:
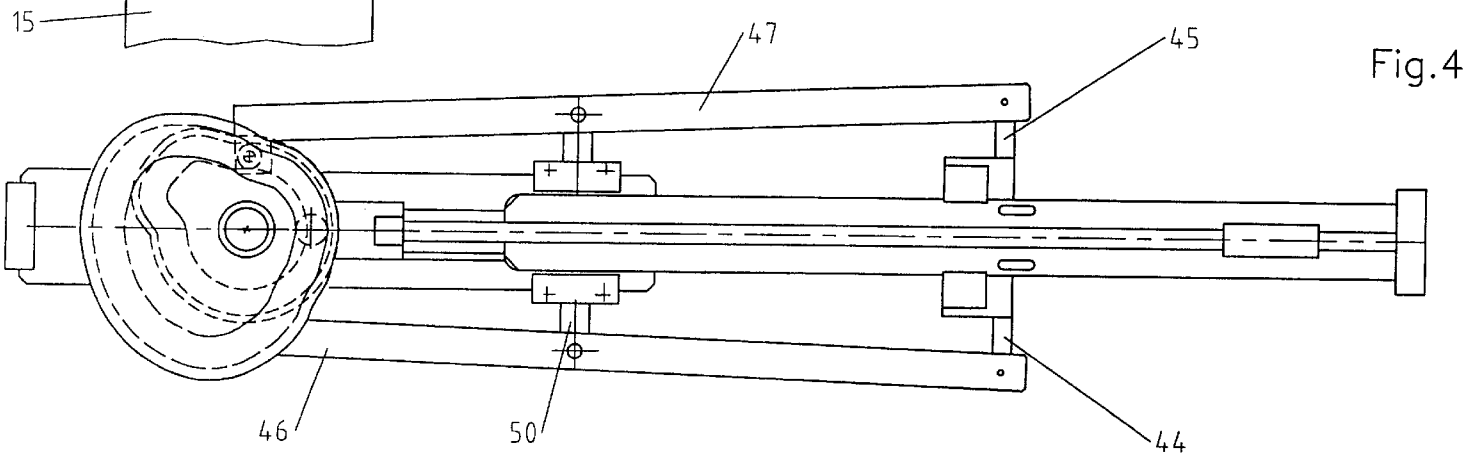
Figure 5:
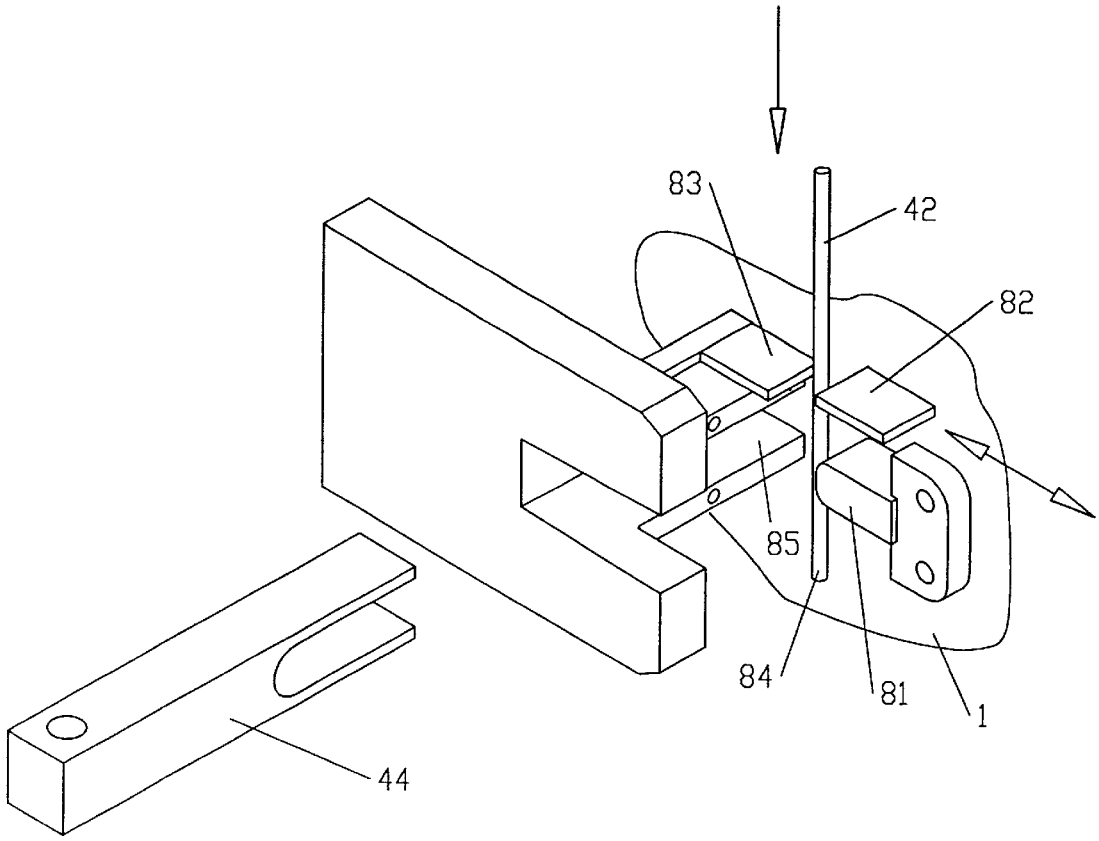
FIG. 5 is a perspective drawing of the cutting and bending mechanism.

FIG. 5 shows a mechanism intended to cut and bend the bent wire closure in an enlarged view compared to that in FIG. 2 with a bending stamp 81 and a cutting block 82 on the constricting plate 1 that moves back and forth in the direction of the double arrows. Upon movement to the left (opening of the constriction plates), the cutting block 82 is moved against the cutter 83 along with the wire 42, so that the end 84 of the wire 42 projecting downward is cut off. The cut wire end is then moved by the further movement of the constricting plate 1 farther to the left by the bending stamp 81 into the bending matrix 85, so that a U-shaped bent wire closure is produced.

As soon as the bending process is complete, the U-shaped bent wire closure is pushed through the opening 43 (FIG. 1) in the constricting plate by the plunger 44 into a guide groove in a transport mechanism (not shown) positioned behind the constriction plate 1. From there, the U-shaped bent wire closure is pushed into the position required for the bent wire closure to be closed around the constricted tube, and is pressed against the existing bending matrix there, so that the free ends of the bent wire closure may be bent around the constricted area of the tube.

Figure 6:
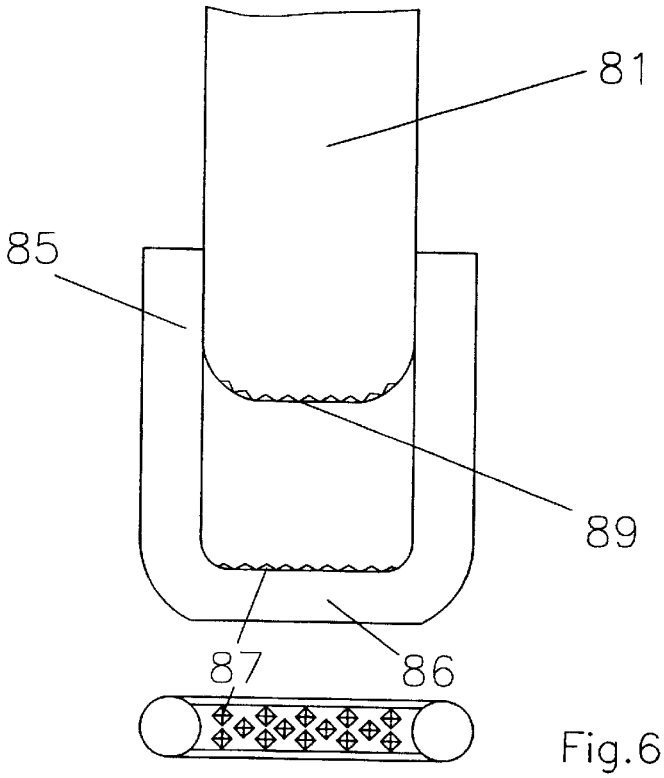
FIG. 6 is a detailed view of the bending mechanism.
Figure 7:
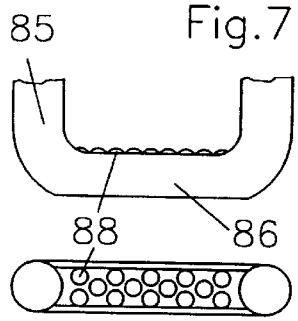
FIG. 7 through FIG. 10 are examples of bent wire closures.

FIG. 6 shows the stamp 81 and a pre-shaped bent wire closure 85 in two views. A gripping pattern is placed on the base 86 of the bent wire closure 85, for which a negative image 89 of the gripping pattern 87 is formed into the stamp 81.

The bent wire closure provided with a gripping pattern is pressed around the constricted tube material and clamped shut without any further shaping processes. There are no further processes performed during which the gripping pattern might be deformed in any way. Experiments have shown that markedly better gripping qualities are achieved using gripping patterns with raised bumps rather than using concave patterns.

Figure 8:
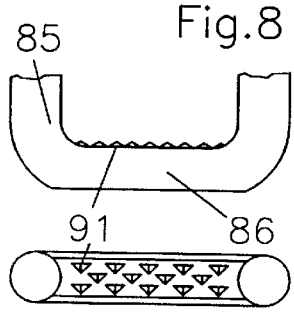
Figure 9:
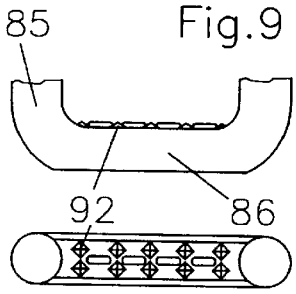
Figure 10:
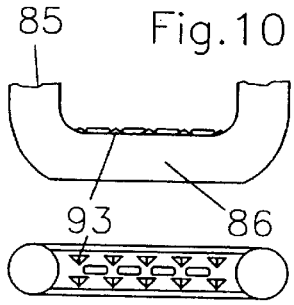

A particularly advantageous embodiment of the invention would feature triangular pyramid-shaped bumps as individual components of the gripping pattern arranged in offset lines so that the gripping pattern covers the entire constricted tube surface perpendicular to the notional direction of possible slippage of the bent wire closure. For this, the triangular pyramid-shaped bumps are arranged perpendicular to the direction of anticipated stress so that the individual elements bite into the tube material. Such a gripping pattern is shown in FIG. 8. Other gripping patterns may also be used, e.g., lens-shaped bumps (FIG. 7) and square-shaped pyramids (FIG. 6), or bead-shaped bumps arranged in a middle line between two outer rows of pyramids, as shown in FIGS. 9 and 10.

A further advantage of the mechanism described in FIG. 6 consists of the fact that the base of the bent wire closure is slightly flattened by the stamping of the gripping pattern. This provides the gripping pattern with greater surface area. Offset placement of the bumps also allows the bent wire closure to provide a better air-tight seal.

Figure 11:
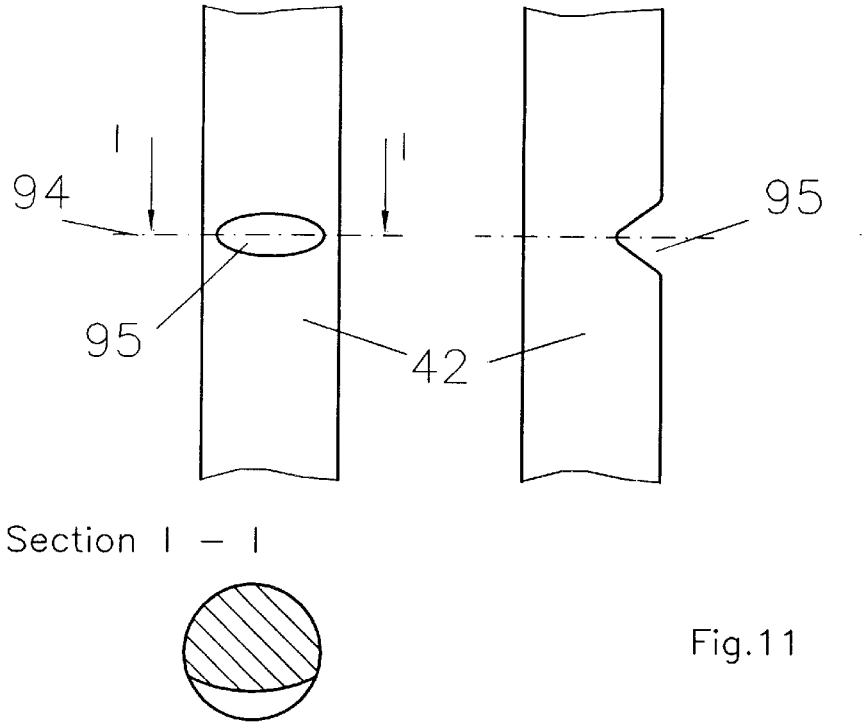
FIG. 11 is a detailed view of a wire.
Figure 12:
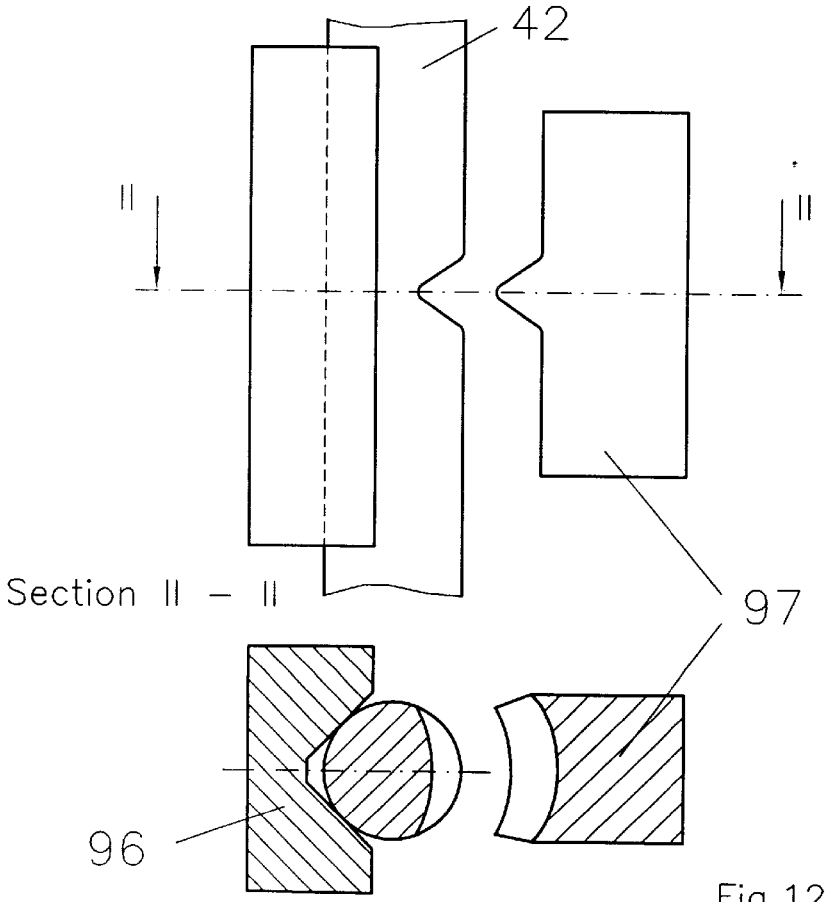
FIG. 12 shows a wire in a notching tool.

FIG. 11 shows a section of the wire in three views, in which a notch 95 is formed at the future cutting point 94. FIG. 12 shows such a wire within the notching tool that consists of a counter-holder 96 and a stamp 97, also in three aspects. This notching tool might preferably be integrated into the holding jaws of the wire feed mechanism. Thus, the separation between the notching tool and the wire cutter would be an integral multiple of the wire length of a bent wire closure.

There has thus been shown and described a novel mechanism to produce filled, sealed tubular bag packages which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. In a mechanism for producing filled, sealed tubular bag packages from a filled tube wherein the filled tube is constricted to form the ends of two sequential tubular bag packages, and the constricted area of the tube is sealed by two surrounding, separated bent wire closures, wherein two groups of constricting plates are pressed from both sides against the area of the tube to be constricted, the mechanism comprising means for cutting and bending the wire into U-shaped bent wire closures, and a transport mechanism for the U-shaped bent wire closures used to seal the constricted area, wherein the cutting and bending means each respectively include a bending stamp and a cutting block disposed outside the constricting plates of one group, and fixed counterpieces, and are driven with the constricting plates, and wherein the transport mechanism is arranged between the constricting plates of one group and is formed by at least one rod running in a groove, the improvement wherein the constricting plates together with the cutting and bending means are driven by a common drive shaft via cam disks rotating around the common drive shaft, and wherein two bi-directionally operating cam disks are provided for each group of constricting plates, and one bi-directionally operating cam disk is additionally provided for the transport mechanism.

2. Mechanism as in claim 1, wherein the completed bent wire closures are pushed from the cutting and bending means through openings in one of the constricting plates by plungers and are driven by rocker arms and additional cam disks.

3. Mechanism as in claim 1, wherein at least one of the cam disks provided for one group of constricting plates includes an additional cam lobe used to operate the cutting means.

4. Mechanism as in claim 1, wherein a forwarding means for the wires is driven by the common drive shaft, said forwarding means including two alternately opening and gripping clamping mechanisms for the wires, one of the clamping mechanisms being driven to move back and forth along the direction of travel of the wires, and the other clamping mechanism being stationary.

5. Mechanism as in claim 1, wherein two strips extended in the direction of motion of the constricting plates are provided, the ends of which are connected to a frame, and which act for most of their length as guides for supporting blocks that hold the constricting plates, and which also provide support for the common drive shaft.

6. Mechanism as in claim 5, wherein the strips include slots for the means for cutting and bending the supplied wires.

7. Mechanism as in claim 1, wherein one rotation of the common drive shaft provides one cycle of the constricting plates, transport and closing of the bent wire closures, and separation of the tubular bag packages.

8. Mechanism as in claim 1, wherein the rotational speed of the common drive shaft is continually adjustable.

9. Mechanism as in claim 1, wherein the cam disks are so shaped that the time during which the constricting plates are open exceeds the time for which the constricting plates are closed.

10. Mechanism as in claim 4, further comprising a notching tool to notch the wire at the position to be subsequently cut, said notching tool being so constructed that the surface of the bent wire closure in contact with the filled portion of the package is provided with a smooth, rounded face.

11. Mechanism as in claim 10, wherein the notching tool is integrated into holding jaws of the wire supply feed mechanism.

12. Mechanism as in claim 1, further comprising a stamp to produce a gripping pattern on one side of the contact surface of the bent wire closure while it is being shaped.

13. Mechanism as in claim 12, wherein the gripping pattern includes raised bumps.

14. Mechanism as in claim 13, wherein the raised bumps are arranged in several lines whereby the bumps in each line are symmetrically offset from each other.

15. Mechanism as in claim 13, wherein the raised bumps are lens-shaped, triangular pyramid-shaped, or square pyramid-shaped.

16. Mechanism as in claims 14, comprising a center line of bumps consisting of several bead-shaped bumps arranged along the longitudinal direction of the gripping profile.

* * * * *